US009755288B2

(12) United States Patent
Lukkarila

(10) Patent No.: US 9,755,288 B2
(45) Date of Patent: Sep. 5, 2017

(54) METHODS AND DEVICES FOR INTEGRATING RADIO FREQUENCY AND OTHER SIGNALS WITHIN A CONDUCTOR

(71) Applicant: Radio Frequency Systems, Inc., Meriden, CT (US)

(72) Inventor: Teppo M. Lukkarila, Wallingford, CT (US)

(73) Assignee: Alcatel-Lucent Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 14/499,909

(22) Filed: Sep. 29, 2014

(65) Prior Publication Data

US 2016/0211565 A1 Jul. 21, 2016

(51) Int. Cl.

| | |
|---|---|
| ***H01P 1/205*** | (2006.01) |
| ***H01P 1/207*** | (2006.01) |
| ***H01P 11/00*** | (2006.01) |
| ***H01P 7/04*** | (2006.01) |
| ***H01P 1/208*** | (2006.01) |
| *H01P 5/02* | (2006.01) |
| *H01P 1/20* | (2006.01) |

(52) U.S. Cl.

CPC ..... *H01P 1/2053* (2013.01); *H01P 1/207* (2013.01); *H01P 1/208* (2013.01); *H01P 7/04* (2013.01); *H01P 11/001* (2013.01); *H01P 1/2007* (2013.01); *H01P 5/02* (2013.01)

(58) Field of Classification Search

CPC .. H01P 7/04; H01P 1/202; H01P 1/205; H01P 1/2053; H01P 5/02; H01P 1/207; H01P 11/001; H01P 1/2007; H01P 1/208

USPC ..... 333/206, 207, 222, 223, 202, 203, 224, 333/225, 226

See application file for complete search history.

(56) References Cited

U.S. PATENT DOCUMENTS 5,691,675 A * 11/1997 Hatanaka ..... H01P 1/20 333/202

* cited by examiner

*Primary Examiner* — Benny Lee
*Assistant Examiner* — Jorge Salazar, Jr.
(74) *Attorney, Agent, or Firm* — The Capitol Patent & Trademark Law Firm, PLLC

(57) ABSTRACT

Non-coaxial conductors, such as direct current power conductors, may be inserted into, or separated from, a central section of a radio frequency (RF) coaxial conductor that is supplying RF signals.

24 Claims, 6 Drawing Sheets

METHODS AND DEVICES FOR INTEGRATING RADIO FREQUENCY AND OTHER SIGNALS WITHIN A CONDUCTOR

Wireless communication facilities typically include a ground-based shelter or enclosure and one or more towers on which are fixed multiple antennas. The antennas typically transmit and receive radio frequency (RF) signals. In one existing configuration the RF signals are provided to (or fed from) the antennas on top of the tower using feeder cables that run from/to the bottom of the tower to/from the antennas on top of the tower. In another configuration, the RF signals are generated by a remote radio head (RRH) unit that is mounted on the top of the tower, close to the antennas. Though this later design removes the need to supply RF signals using feeder cables, it still requires direct current (DC) power, alarm, and data signals to be supplied to the RRH using separate cables.

Presently, a typical tower may include a number of RRHs and antennas. Accordingly, the number of cables and associated conductors inside such cables (e.g., copper, fiber optic, coaxial) needed to supply RRHs and antennas on top of a tower with power, data, alarm and RF signals has increased. In fact, many newly installed towers cannot support the added weight of the cables required. Even if a tower can physically support the weight of such cables, the cost of installing, accessing and maintaining RRHs and antennas is very expensive.

One existing design attempts to reduce the weight associated with the number of cables by using a hybrid cable that contains both the DC power conductors and optical fibers used for data signals surrounded by a protective metal sheath or the like. This design requires the installation of a separate set of cables in addition to the existing RF coaxial feeder cables.

Another design proposes to use the RF coaxial feeder cables to also supply the DC power or data. However, this design does not allow the coaxial feeder cables to be used to supply RF signals, which is unacceptable.

It is therefore desirable to provide methods and devices for supplying power, data and RF signals to RRHs and antennas on a tower that overcome the disadvantages of the existing designs.

SUMMARY

Exemplary embodiments of methods and devices for supplying power, data, alarm and RF signals to RRHs and antennas are provided by, for example, by allowing the insertion and separation of non-coaxial conductors into, or from, RF coaxial conductors that are supplying RF signals.

One such device is referred to as a cavity structure that is used or installed at, or near, the bottom of an antenna tower. According to one embodiment, such a cavity structure may comprise: an input section formed in the cavity structure, and configured to allow for the connection of a RF coaxial conductor that is configured to supply RF signals to a resonator structure of the cavity structure; and one or more passageways formed in the cavity structure, each passageway comprising a resonator passageway section formed in a resonator of the resonator structure, and each passageway configured to allow for the insertion of one or more non-coaxial, conductors to a central section of an output RF coaxial conductor.

In embodiments, the resonator structure may comprise an RF resonator structure operable to process frequencies in the 300 megahertz to 6 gigahertz frequency range. The cavity structure may comprise a cavity filter, where the cavity filter is selected from at least the group consisting of an all-pass, broadband, narrowband and multi-passband filter.

In yet other embodiments, the cavity structure may comprise an RF combiner or an RF diplexer.

One or more (e.g., two) passageways within the cavity structure may be further configured to allow for the insertion of, for example, some combination of the following: (i) one or more DC power conductors to the central section of an output RF coaxial conductor; (ii) one or more DC power conductors, one or more data signal conductors, and one or more alarm signal conductors to the central section of an output RF coaxial conductor; or (iii) one or more data signal conductors and/or one or more alarm signal conductors to the central section of the output RF coaxial conductor.

Certain other embodiments need not use a resonator passageway section as part of a passageway. In these embodiments a cavity structure may comprise: an input section formed in a cavity structure, and configured to allow for the connection of an RF input coaxial conductor that is configured to supply RF signals to a resonator structure of the cavity structure; and one or more passageways formed in the cavity structure, each passageway configured to allow for the insertion of one or more non-coaxial, conductors to a central section of an output coaxial conductor.

In addition to providing devices that may be used or installed at, or near, the bottom of an antenna tower the present invention also provides for devices that may be used at, or near, the top of an antenna tower. Both types of devices may be connected together using connecting cables, for example.

In one embodiment the device comprises a cavity structure located at, or near the top of a tower. Such a cavity structure may comprise: an input section configured to allow for the connection of an input RF coaxial conductor configured to supply RF signals to a resonator structure of the cavity structure, and at least one passageway formed in a cavity structure configured to allow for the separation of one or more non-coaxial, conductors in a central section of the input RF coaxial conductor from the central section, and allow for connection of the separated, non-coaxial conductors to one or more output non-coaxial conductors; and an output section configured to allow for the connection of an output RF coaxial conductor to the resonator structure of the cavity structure.

Similar to the embodiments of structures discussed above, the resonator structure may comprise an RF resonator structure that is operable to process frequencies in the 300 megahertz to 6 gigahertz frequency range, and the cavity structure may comprise a cavity filter, RF combiner or an RF diplexer. The cavity filter may be selected from at least the group consisting of an all-pass, broadband, narrowband and multi-passband filter.

At least one passageway formed in the cavity structure may be configured to allow for the separation of one or more DC power conductors from a central section. Alternatively, at least two passageways may be formed in the cavity structure, each configured to allow for the separation of one or more DC power conductors, one or more data signal conductors, and one or more alarm signal conductors from the central section, or some combination of the above conductors, for example.

Alternatively, at least one passageway in the cavity structure may be configured to allow for the separation of a combination of: (i) one or more data signal conductors and one or more alarm signal conductors from the central section; or (ii) one or more data signal conductors or one or more alarm signal conductors from the central section.

Certain other embodiments need not use a resonator passageway section as a part of a passageway. In these embodiments a cavity structure may comprise: an input section configured to allow for the connection of an input RF coaxial conductor configured to supply RF signals to a resonator structure of the cavity structure, and at least one passageway formed in a cavity structure, the passageway configured to allow for the separation of one or more non-coaxial, conductors in a central section of the input RF coaxial conductor from the central section, and allow for connection of the separated, non-coaxial conductors to one or more output non-coaxial conductors; and an output section configured to allow for the connection of an output RF coaxial conductor to the resonator structure of the cavity structure.

In addition to devices, the present invention provides for methods for integrating RF and other signals with a conductor. One such method may comprise: inserting non-coaxial conductors into a cavity structure that includes RF coaxial conductors configured to supply RF signals; and connecting the non-coaxial conductors using connectors. The method may further comprise cutting each of the non-coaxial conductors prior to insertion.

Other methods that are used with the cavity structures described herein are provided by the present invention.

Additional features will be apparent from the following detailed description and appended drawings.

EXEMPLARY EMBODIMENTS AND DETAILED DESCRIPTION

Figure 1:
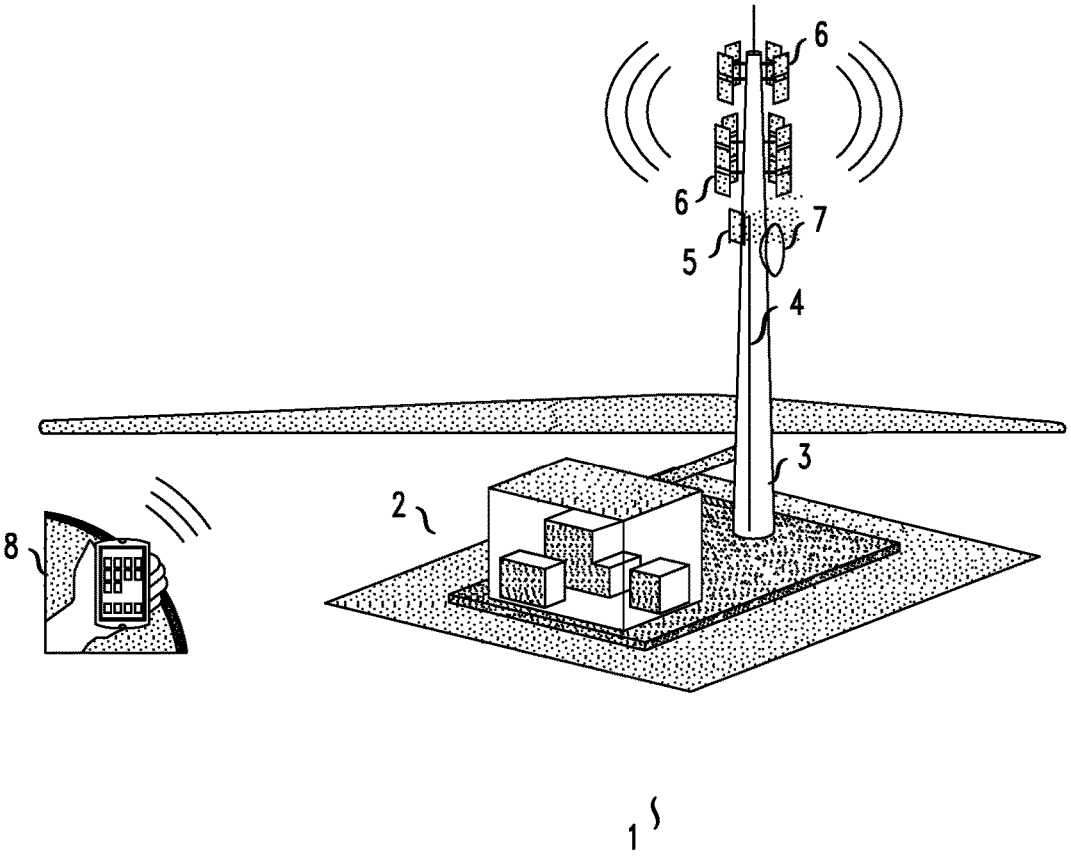
FIG. 1 (PRIOR ART)
FIG. 1 depicts a simplified representation of a typical wireless communication shelter and tower installation.

Exemplary embodiments for integrating RF and other signals within a conductor are described herein and are shown by way of example in the drawings. Throughout the following description and drawings, like reference numbers/characters refer to like elements.

It should be understood that, although specific exemplary embodiments are discussed herein, there is no intent to limit the scope of present invention to such embodiments. To the contrary, it should be understood that the exemplary embodiments discussed herein are for illustrative purposes, and that modified and alternative embodiments may be implemented without departing from the scope of the present invention.

It should also be noted that one or more exemplary embodiments may be described as a process or method. Although a process/method may be described as sequential, it should be understood that such a process/method may be performed in parallel, concurrently or simultaneously. In addition, the order of each step within a process/method may be re-arranged. A process/method may be terminated when completed, and may also include additional steps not included in a description of the process/method.

As used herein, the term "and/or" includes any and all combinations of one or more of the associated listed items. As used herein, the singular forms "a," "an" and "the" are intended to include the plural form, unless the context and common sense indicates otherwise.

As used herein, the term "embodiment" refers to an embodiment of the present invention.

FIG. 1 depicts a simplified representation of a typical wireless communication shelter and tower installation 1. The depicted installation 1 shows a ground-based shelter 2, tower 3, connecting cables 4, an RRH 5, associated antennas 6 for exchanging communications with wireless users 8 as well as other antennas 7 that are used to connect the installation 1 with other similar installations, to a communications central office, and/or to a long distance communications network, for example. Though only a single RRH 5 is shown in FIG. 1, it should be understood that more than one may be included in a typical installation 1. Other connecting cables and conductors, such as those that connect RRH 5 and antennas 6 exist but are not shown in FIG. 1 for the sake of brevity.

Within the cables 4 are conductors that provide the RF signals, operating power, data and alarm signals. As the number of antennas and RRHs increase, so too does the number of conductors required. In accordance with embodiments of the invention, instead of placing each conductor in its own cable, the conductors used to supply data, power and alarm signals may be combined with the coaxial conductor (and its associated cable) that is used to supply RF signals. Accordingly, fewer cables are required which in turn reduces the weight (load) on an antenna tower.

Figure 2:
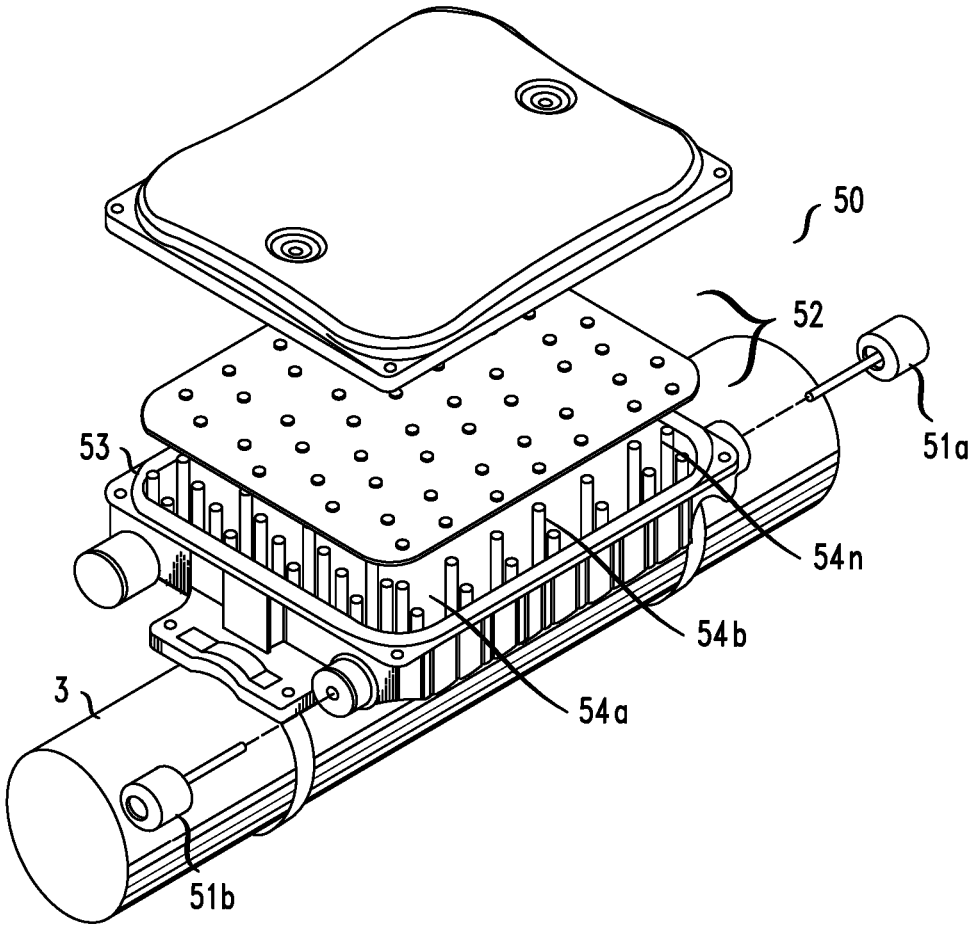
FIG. 2 (PRIOR ART)
FIG. 2 depicts an exploded view of a traditional cavity filter.

Referring now to FIG. 2, there is depicted an exploded view of a traditional cavity filter 50 shown attached to a section of tower 3. Though not shown in FIG. 1, cavity filters, such as filter 50 may be attached at the bottom and top of a the tower 3. Filter 50 is shown as including a cavity structure 52 and coaxial connectors 51*a*,51*b*. One of the connectors 51*a* may be used to connect a coaxial cable supplying RF signals into the filter 50 (i.e., input signals) and may be referred to as an input connector. The other connector 51*b* may be used to connect a coaxial cable carrying RF signals that are output from the filter 50 (i.e., output signals) and may be referred to as an output connector. As shown, the cavity structure 52 comprises a resonator structure 53. Within the resonator structure 53 there are a plurality of resonators 54*a-n*, sometimes referred to as resonator posts, where "n" denotes a last resonator. In embodiments of the invention the resonator structure 53 may be operable to receive a range of RF frequencies making up the RF input signals, remove one or more of the frequencies, and output RF signals that do not include the removed RF frequencies. Said another way, the resonator structure 53 may function as a filter that filters out the one or more frequencies.

Figure 3A:
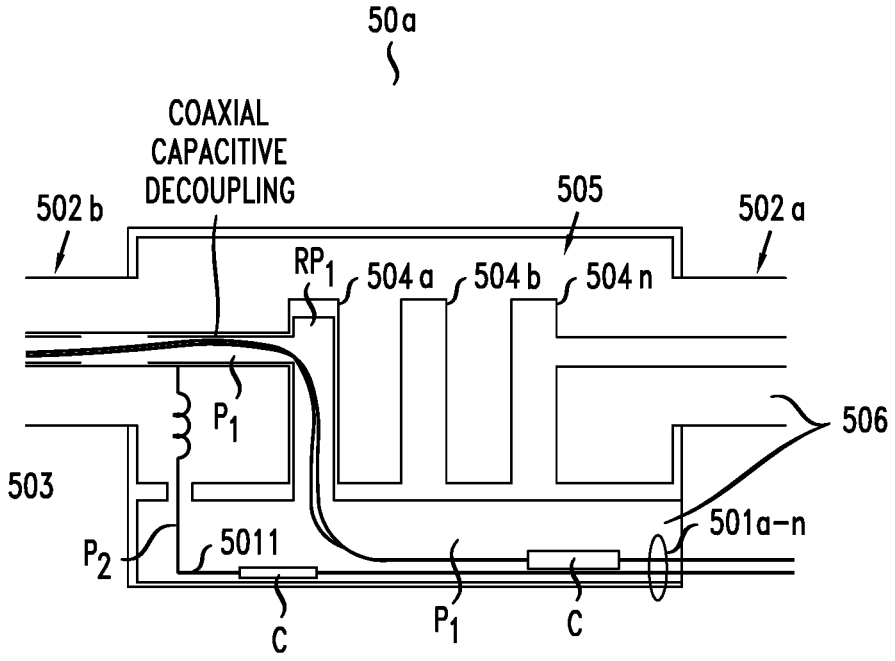
FIG. 3A depicts a simplified cross-sectional view of a cavity structure according to an embodiment of the present invention.

Referring now to FIG. 3A, there is shown an inventive cavity structure 500 in accordance with embodiments of the invention. The cavity structure 500 may comprise one of many types of devices. One type of device is a cavity filter. Yet further, the structure 500 may comprise a cavity filter selected from at least the group consisting of an all-pass, broadband, narrowband and multi-passband filter. Still further, the structure 500 may be a part of an RF combiner or an RF diplexer.

As shown, an input RF coaxial conductor 502*a* configured to supply RF signals and power, data and alarm conductors 501 *a-n*, where "n" denotes a last conductor carrying associated signals, may be connected to an input section 506 of the cavity structure 500 while an output coaxial conductor 502*b* is connected to an output section of the structure 500. Though only one coaxial conductor and single power, data and alarm conductors are shown, this is for the sake of clarity. It should be understood that a plurality of input coaxial conductors and a plurality of power, alarm and data conductors may be connected to the input section 506. Further, it should be understood that the conductors 502*a,b* and 501 *a-n* may be a part of one or more multi-conductor cables or the like. Yet further, the conductors 502*a,b* and 501 *a-n* may include the necessary connectors for connecting to the structure 500. For the sake of ease of illustration, the details of the connectors are not shown in FIG. 3A. Structure 500 further comprises an RF resonator structure 505 and associated resonators 504*a-n* (where "n" denotes a last resonator) within the cavity structure 500 that are operable to process radio frequencies in the 300 megahertz to 6 gigahertz frequency range, for example.

In embodiments of the invention, the power, data and alarm conductors 501 *a-n* may be inserted into a central section 503 of the output RF coaxial conductor 502*b* configured to supply RF signals in order to reduce the amount of cabling needed. In one exemplary embodiment the central section 503 may be hollow.

In more detail, the structure 500 may be located at the bottom or towards the bottom of a tower, such as tower 3. By inserting the power, data and alarm conductors 501 *a-n* (i.e., the non-coaxial conductors) into the central section 503 of the output RF coaxial conductor 502*b* as shown, there is no longer a need to provide separate cables to enclose the power, data and alarm conductors 501 *a-n*. Instead, the power, data and alarm non-coaxial conductors 501 *a-n* along with the RF coaxial conductor 502*b* are all enclosed in the same cable; that is, in a cable that surrounds the power, data and alarm non-coaxial conductors 501 *a-n* and the RF coaxial conductor 502*b* configured to supply RF signals. Accordingly, unlike existing designs, in the embodiment depicted in FIG. 3A, RF signals may be supplied by the same cable that surrounds the inserted non-coaxial conductors 501 *a-n*. The elimination of separate cables reduces the weight or load on the tower 3, among other things.

In more detail, in accordance with an embodiment of the invention to allow the power, data and alarm conductors 501 *a-n* to be inserted into the central section 503 of the RF coaxial conductor 502*b* the cavity structure 500 may include one or more passageways $P_1$ formed in the cavity structure 500. In the embodiment depicted in FIG. 3A each passageway $P_1$ is shown comprising a resonator passageway section $RP_1$ formed in a resonator 504*a* of the resonator structure 505. Though only a single passageway $P_1$ is depicted in FIG. 3A it should be understood that more than one passageway may be formed. Each formed passageway, however, is configured to allow for the passage and insertion of one or more different (or the same) type of non-coaxial conductors to the central section 503 of the output coaxial conductor 502*b*. Some non-limiting examples of non-coaxial conductors are the power, data and alarm conductors 501 *a-n* mentioned herein that may comprise optical fibers or copper wire to name two examples.

Though the structure 500 in FIG. 3A depicts the passageway $P_1$ as being located at, or traversing, the bottom of the structure 500, this is also for illustration purposes. Alternatively, in addition to the bottom section, a passageway may be located at, or traverse, a different section of the structure 500 such as a side or top of the structure 500.

As mentioned before, the structure 500 further comprises an input section 506 formed in the cavity structure 500 that may be configured to allow for the connection of the input coaxial conductor 502*a* to the resonator structure 505.

In an alternative embodiment, a passageway may be formed without the inclusion (or without traversing) a resonator section $RP_1$ (or resonator 504*a-n*). In such a case, each of the one or more passageways formed in the cavity structure 500 may still be configured to allow for the insertion of one or more non-coaxial conductors 501 *a-n* into a central section 503 of the output coaxial conductor 502*b*. For example, a passageway may be formed by allowing the non-coaxial conductors 501-*a-n* to traverse the structure 500 and enter the central section 503 through, for example, an opening in the bottom, side or top walls of the structure 500.

The number and type, number and combination of conductors that are inserted into the central section 503 of the output RF coaxial conductor 502*b* may vary. For example, in one embodiment the passageway $P_1$ may be configured to allow for the insertion of one or more data signal conductors and one or more alarm signal conductors making up conductors 501 *a-n* to the central section 503 of the output RF coaxial conductor 502*b*. In another embodiment, the passageway $P_1$ may be configured to allow for the insertion of one or more data signal conductors or one or more alarm signal conductors making up conductors 501 *a-n* to the central section 503 of the output RF coaxial conductor 502*b*.

Rather than, or in addition to, inserting data and alarm signal conductors into the central section 503 of the output RF coaxial conductor 502*b*, power signal conductors (e.g., DC conductors) may be inserted into the central section 503. For example, in yet another embodiment, a second one of the passageways, denoted $P_2$ in FIG. 3A, may be configured to allow for the insertion of one or more DC current conductors 5011 to the central section 503 of the output RF coaxial conductor 502*b*. As shown in the embodiment of FIG. 3A, the passageway $P_2$ does not include (and does not traverse) a resonator section $RA_1$ (or resonator 504*a-n*).

It should be understood that that the non-coaxial conductors 501 *a-n* may only comprise a single type of non-coaxial conductor or may comprise many different types. In the case where the non-coaxial conductors 501*a-n* only comprise DC power conductors (or alternatively, data or alarm signal conductors), the DC conductors may be inserted into the central section 503 using a passageway formed similar to passageway $P_1$ or formed similar to passageway $P_2$.

In yet an additional embodiment, two passageways, one similar to $P_1$ and the other similar to $P_2$ may be formed in the structure 500. This alternative may be attractive when the non-coaxial conductors 501*a-n* comprise a mixture of DC power, data and alarm conductors. In such an instance the two passageways $P_1$, $P_2$ may be configured to allow for the insertion of one or more DC power conductors, one or more data signal conductors, and one or more alarm signal conductors or some combination of the three to the central section 503 of the output RF coaxial conductor 502*b* as shown in FIG. 3A.

Figure 3B:
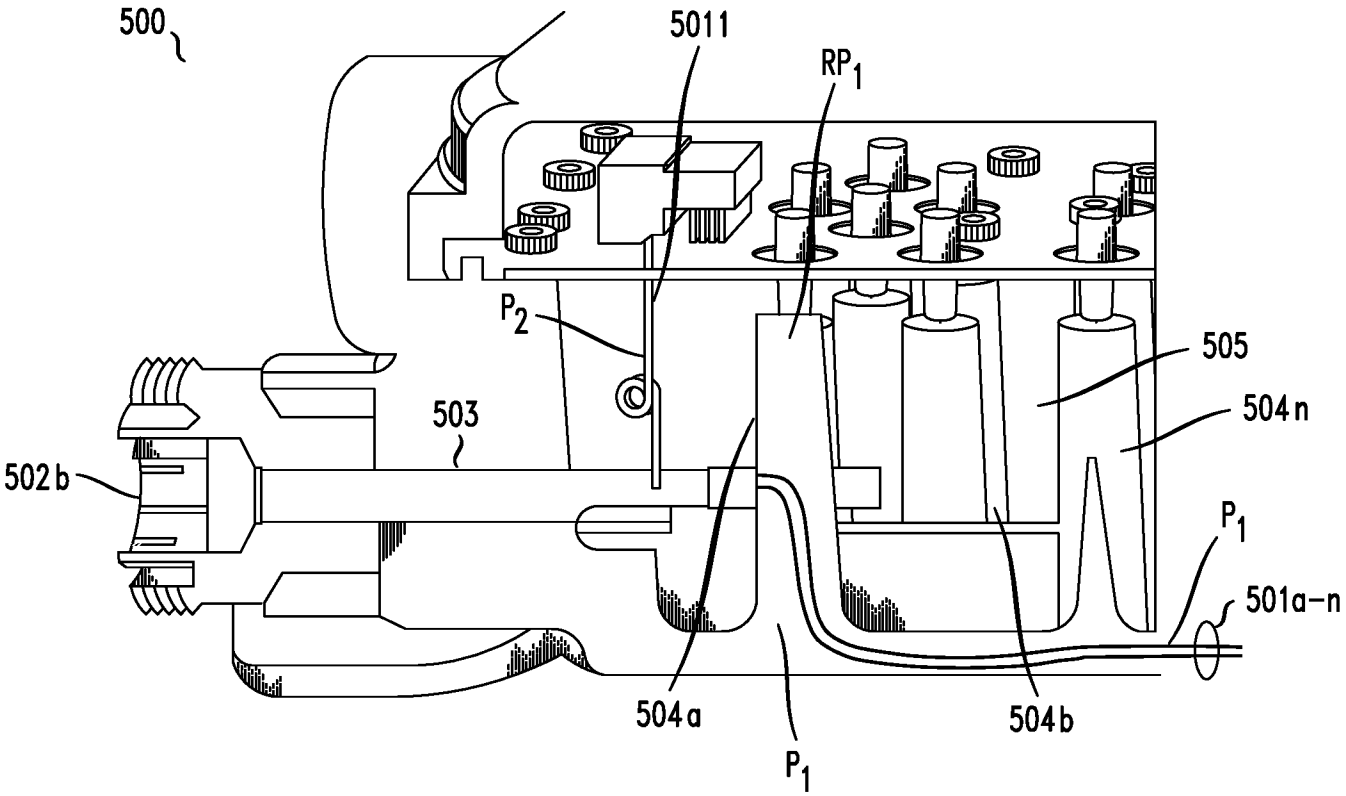
FIG. 3B depicts a cross-sectional view of part of a cavity structure according to an embodiment of the present invention.

Referring now to FIG. 3B there is depicted a cross-sectional view of part of a cavity structure 500 according to another embodiment. In more detail, FIG. 3B depicts the output side of the structure 500. As shown, the cavity structure 500 includes passageway $P_1$ formed in the cavity structure 500, where the passageway $P_1$ includes a resonator passageway section $RP_1$ formed in a resonator 504*a* of the resonator structure 505. The passageway $P_1$ is configured to allow for the passage and insertion of one or more different (or the same) type of non-coaxial, conductors 501*a-n* to the central section 503 of an output coaxial conductor 502*b*. Also depicted is another passageway $P_2$ configured to allow for the insertion of one or more DC power conductors 5011 into the central section 503 of the output RF coaxial conductor 502*b* configured to provide RF signals.

The description above illustrates how the number of cables needed to supply RF, data, power and alarm signals from the bottom of a tower to the top may be reduced by using a cavity structure located at the bottom of the tower that combines the RF, data, power and alarm signal conductors. Of course, at the top of the tower the so combined conductors may need to be separated in order to be connected and used properly.

Figure 4A:
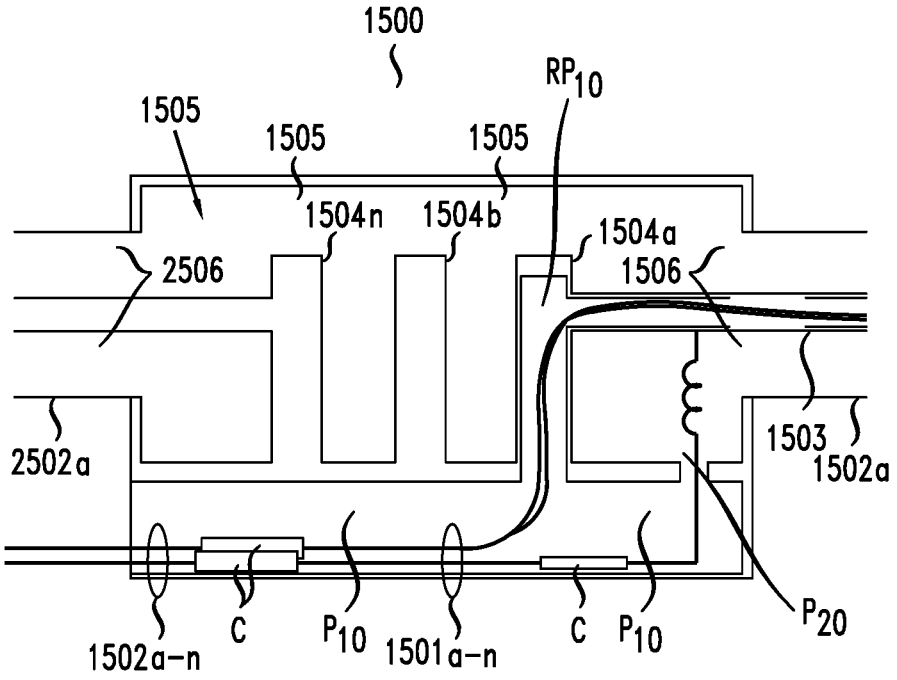
FIG. 4A depicts a simplified cross-sectional view of another cavity structure according to yet another embodiment of the present invention.

Referring to FIG. 4A there is depicted a cavity structure 1500 for separating one or more non-coaxial conductors 1501 *a-n* (where "n" denotes a last conductor) from a central section 1503 of an input RF coaxial conductor 1502*a* configured to supply or provide RF signals. As depicted the structure 1500 comprises an input section 1506 configured to allow for the connection of the input RF coaxial conductor 1502*a* to a resonator structure 1505 of the cavity structure 1500. The RF signals being supplied by the conductor 1502*a* may originate from an RRH or from feeder cables as described before. In addition, the structure 1500 comprises at least one passageway $P_{10}$ formed in the cavity structure 1500, where the passageway $P_{10}$ comprises a resonator passageway section $RP_{10}$ formed in a resonator 1504*a-n* of the resonator structure 1505. The passageway $P_{10}$ is configured to allow for the separation of one or more non-coaxial, conductors 1501*a-n* in the central section 1503 of the input RF coaxial conductor 1502*a* from the central section 1503. In sum, the structure 1500 separates the input RF coaxial conductor 1502*a* into separate conductors, such as conductors 502*a* and 501*a-n* shown in FIGS. 3A and 3B.

In addition to separating the one or more non-coaxial, conductors 1501*a-n* (where "n" denotes a last conductor) from the central section 1503, the passageway $P_{10}$ allows for connection of the separated, non-coaxial conductors 1501*a-n* to one or more output non-coaxial conductors 2501*a-n* (where "n" again denotes a last conductor).

As also depicted in FIG. 4, the structure 1500 further comprises an output section 2506 configured to allow for the connection of an output RF coaxial conductor 2502*a* configured to provide RF signals to the resonator structure 1505 of the cavity structure 1500. Similar to the structures shown in FIGS. 3A and 3B, the resonator structure 1505 may comprise an RF resonator structure 1505 that is operable to process radio frequencies in the 300 megahertz to 6 gigahertz frequency range.

Further, the cavity structure 1500 may comprise one of many types of devices. One type of device is a cavity filter. Yet further, the structure 1500 may comprise a cavity filter selected from at least the group consisting of an all-pass, broadband, narrowband and multi-passband filter. Still further, the structure 1500 may be a part of an RF combiner or an RF diplexer.

Though the structure 1500 depicts the passageway $P_{10}$ as being located at, or traversing, the bottom of the structure 1500, this is also for illustration purposes. Alternatively, in addition to the bottom section, a passageway may be located at, or traverse, a different section of the structure 1500 such as a side or top of the structure 1500.

The number and type of conductors that can be separated from the central section 1503 of the input RF coaxial conductor 1502*a* may vary. In general, any conductor within the central section 1503 may be separated. For example, in one embodiment the passageway $P_{10}$ may be configured to allow for the separation of one or more DC power conductors, one or more data signal conductors, or one or more alarm signal conductors making up conductors 1501*a-n* from the central section 1503. In another embodiment, the passageway $P_{10}$ may be configured to allow for the separation of one or more data signal conductors and one or more alarm signal conductors making up conductors 1501*a-n* from the central section 1503. In still another embodiment, the passageway $P_{10}$ may be configured to allow for the separation of either one or more data signal conductors or one or more alarm signal conductors making up conductors 1501*a-n* from the central section 1503.

Instead of using a single passageway, two or more passageways may be used to separate conductors. This alternative may be attractive when the non-coaxial conductors 1501*a-n* comprise a mixture of DC power, data and alarm conductors. In such an instance two passageways $P_{10}$, $P_{20}$ may be configured to allow for the separation of one or more DC power conductors, one or more data signal conductors, and one or more alarm signal conductors or some combination of the three from the central section 1503. For example, passageway $P_{20}$ may be configured to allow for the separation of one or more DC power conductors, while passageway $P_{10}$ may be configured to allow for the separation of one or more data signal conductors, and/or one or more alarm signal conductors from the central section 1503.

In an alternative embodiment, a passageway may be formed without the inclusion (or without traversing) a resonator section $RP_{10}$ (or resonator 1504*a-n*). In such a case, each of the one or more passageways formed in the cavity structure 1500 may still be configured to allow for the separation of one or more non-coaxial, conductors 1501 *a-n* from the central section 1503 of the input coaxial conductor 1502*a*. For example, a passageway may be formed by allowing the non-coaxial conductors 1501-*a-n* to exit the central section 1503 through, for example, an opening in the bottom, side or top walls of the structure 1500 and then traverse the structure 1500.

Figure 4B:
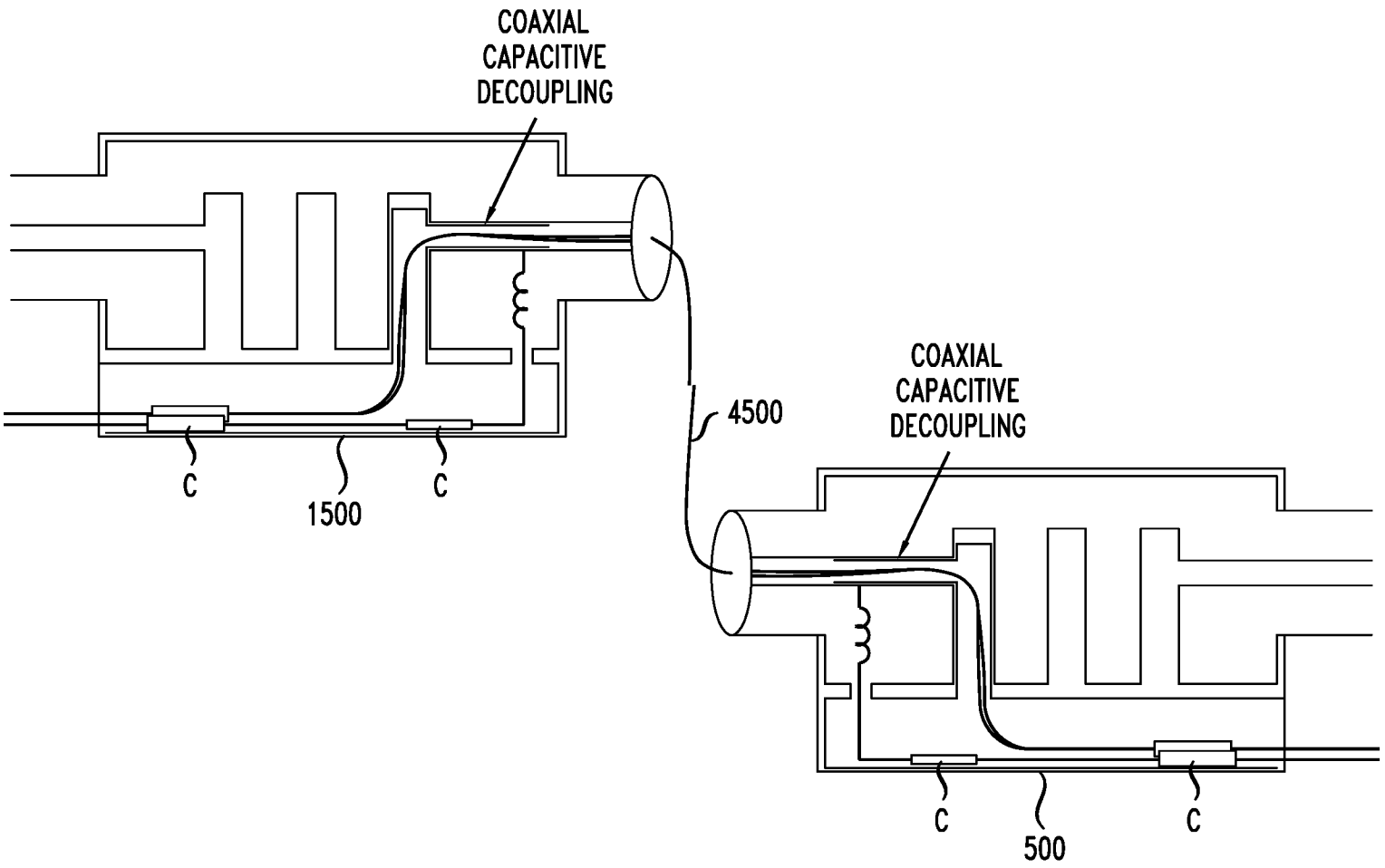
FIG. 4B depicts a simplified cross sectional view of the cavity structures shown in FIGS. 3A and 4A according to another embodiment of the present invention.

Referring now to FIG. 4B there is shown an embodiment of the invention that depicts structures, such as structure 500 in FIG. 3A and structure 1500 in FIG. 4A, connected together using cables 4500. It should be understood that the structures 500 and 1500 are located at opposite ends of an antenna tower; one towards the top of a tower (e.g., structure 1500) and one towards the bottom of the tower (e.g., structure 500). For ease of explanation the tower is not shown nor are other elements of a base station shown.

The description above has set forth cavity structures in accordance with the present invention. In addition, the present invention provides one or more methods for connecting the non-coaxial conductors shown in FIGS. 3A through 4B. In one embodiment, the non-coaxial conductors may be inserted in to a cavity structure and then connected together with small connectors (see elements "C" in FIGS. 3A, 4A and 4B) during the manufacture of RF coaxial cable/conductors. In such a scenario the non-coaxial conductors may be inserted in a cavity structure that has RF coaxial conductors that are configured to supply RF signals also connected to the structure at its inputs and outputs at a manufacturing facility where the coaxial cable/conductors are made, where each non-coaxial conductor may be cut to an appropriate length prior to insertion in a cavity structure. In an alternative embodiment, the non-coaxial conductors may be fed through a coaxial conductor in the field, after the coaxial conductor has been installed and then connected using connectors (see elements "C"). In this scenario, the non-coaxial conductors may be fed through a cavity structure such as the ones shown in FIGS. 3A through 4B.

It should be understood that in the cavity structures shown in FIGS. 3A through 4B the non-coaxial conductors may have been installed using either method.

While exemplary embodiments have been shown and described herein, it should be understood that variations of the disclosed embodiments may be made without departing from the spirit and scope of the claims that follow.

I claim:

1. A cavity structure comprising:

an input section formed in the cavity structure, and configured to allow for the connection of an input radio frequency (RF) coaxial conductor configured to supply RF signals to a resonator structure of the cavity structure; and one or more passageways formed in the cavity structure, each passageway comprising a resonator passageway section formed in a resonator of the resonator structure, and each passageway configured to allow for the insertion of one or more non-coaxial conductors to a central section of an output RF coaxial conductor.

2. The cavity structure as in claim 1 wherein one of the one or more passageways is further configured to allow for the insertion of the one or more non-coaxial conductors in the form of direct current (DC) power conductors to the central section of the output RF coaxial conductor.

3. The cavity structure as in claim 1 wherein two of the one or more passageways are further configured to allow for the insertion, to the central section of the output RF coaxial conductor, of the one or more non-coaxial conductors selected from the group consisting of: DC power conductors, one or more data signal conductors, and one or more alarm signal conductors.

4. The cavity structure as in claim 1 wherein one of the one or more passageways is further configured to allow for the insertion, to the central section of the output RF coaxial conductor, of the one or more non-coaxial conductors selected from the group consisting of: data signal conductors and one or more alarm signal conductors.

5. The cavity structure as in claim 1 wherein one of the one or more passageways is further configured to allow for the insertion, to the central section of the output RF coaxial conductor, of the one or more non-coaxial conductors selected from the group consisting of data signal conductors or one or more alarm signal conductors.

6. The cavity structure as in claim 1 wherein the resonator structure comprises an RF resonator structure.

7. The cavity structure as in claim 6 wherein the RF resonator structure is operable to process radio frequencies in the 300 megahertz to 6 gigahertz frequency range.

8. The cavity structure as in claim 1 wherein the cavity structure comprises a cavity filter.

9. The cavity structure as in claim 8 wherein the cavity filter is selected from at least the group consisting of an all-pass filter, broadband filter, narrow band filter, and multi-passband filter.

10. The cavity structure as in claim 1 wherein the cavity structure comprises an RF combiner or an RF diplexer.

11. A cavity structure comprising:

an input section formed in the cavity structure, and configured to allow for the connection of an input radio frequency (RF) coaxial conductor configured to supply RF signals to a resonator structure of the cavity structure; and one or more passageways formed in the cavity structure, each passageway configured to allow for the insertion of one or more non-coaxial conductors to a central section of an output coaxial conductor.

12. A cavity structure comprising:

an input section configured to allow for the connection of an input radio frequency (RF) coaxial conductor configured to supply RF signals to a resonator structure of the cavity structure, and at least one passageway formed in the cavity structure comprising a resonator passageway section formed in a resonator of the resonator structure, the passageway configured to allow for the separation of one or more non-coaxial conductors in a central section of the input RF coaxial conductor from the central section, and allow for connection of the separated, non-coaxial conductors to one or more output non-coaxial conductors; and an output section configured to allow for the connection of an output RF coaxial conductor to the resonator structure of the cavity structure.

13. The cavity structure as in claim 12 wherein the resonator structure comprises a radio frequency (RF) resonator structure.

14. The cavity structure as in claim 13 wherein the RF resonator structure is operable to process radio frequencies in the 300 megahertz to 6 gigahertz frequency range.

15. The cavity structure as in claim 12 wherein the cavity structure comprises a cavity filter.

16. The cavity structure as in claim 15 wherein the cavity filter is selected from at least the group consisting of an all-pass filter, broadband filter, narrow band filter, and multi-passband filter.

17. The cavity structure as in claim 12 wherein the cavity structure comprises an RF combiner or an RF diplexer.

18. The cavity structure as in claim 12 wherein the at least one passageway is further configured to allow for the separation of the one or more non-coaxial conductors in the form of direct current (DC) power conductors from the central section.

19. The cavity structure as in claim 12 wherein at least two passageways of the at least one passageway formed in the cavity structure are configured to allow for the separation of the one or more non-coaxial conductors selected from the group consisting of: DC power conductors, one or more data signal conductors, and one or more alarm signal conductors, from the central section.

20. The cavity structure as in claim 12 wherein the at least one passageway is further configured to allow for the separation of the one or more non-coaxial conductors selected from the group consisting of: data signal conductors and one or more alarm signal conductors, from the central section.

21. The cavity structure as in claim 12 wherein the at least one passageway is further configured to allow for the separation of the one or more non-coaxial conductors selected from the group consisting of: data signal conductors or one or more alarm signal conductors, from the central section.

22. A cavity structure comprising:

an input section configured to allow for the connection of an input radio frequency (RF) coaxial conductor configured to supply RF signals to a resonator structure of the cavity structure, and at least one passageway formed in the cavity structure, the at least one passageway configured to allow for the separation of one or more non-coaxial conductors in a central section of the input RF coaxial conductor from the central section, and allow for connection of the separated, non-coaxial conductors to one or more output non-coaxial conductors; and an output section configured to allow for the connection of an output RF coaxial conductor to the resonator structure of the cavity structure.

23. A method for integrating radio frequency and other signals within an output conductor comprising:

inserting non-coaxial conductors configured to supply one or more of DC power signals, data signals, and alarm signals into a cavity structure that includes radio frequency (RF) coaxial conductors configured to supply RF signals; and connecting the non-coaxial conductors using connectors.

24. The method as in claim 23 further comprising cutting each of the non-coaxial conductors prior to insertion.

* * * * *